US007761963B2

(12) United States Patent
Koch et al.

(10) Patent No.: US 7,761,963 B2
(45) Date of Patent: Jul. 27, 2010

(54) BOX

(76) Inventors: Arne Koch, p/a Lage Brink 27, 7317 BD Apeldoorn (NL); Gijsbert Michiel Zijlstra, Roggestraat 20, 6981 BK Doesburg (NL); Leonardus Philomena Matheus Zautsen, Brouwergracht ab t/o 137, NL-1013 HJ Amsterdam (NL)

( * ) Notice: Subject to any disclaimer, the term of this patent is extended or adjusted under 35 U.S.C. 154(b) by 0 days.

(21) Appl. No.: 11/628,330

(22) PCT Filed: Jun. 6, 2005

(86) PCT No.: PCT/NL2005/000407

§ 371 (c)(1),
(2), (4) Date: Jun. 28, 2007

(87) PCT Pub. No.: WO2005/117796

PCT Pub. Date: Dec. 15, 2005

(65) Prior Publication Data

US 2007/0261219 A1 Nov. 15, 2007

(30) Foreign Application Priority Data

Jun. 4, 2004 (NL) ..... 1026336
Sep. 10, 2004 (NL) ..... 1027021

(51) Int. Cl.
*A61G 17/00* (2006.01)

(52) U.S. Cl. ..... 27/2; 27/35; 220/4.28

(58) Field of Classification Search ..... 27/2, 27/17, 35; 220/4.28, 615, 682; 217/65
See application file for complete search history.

(56) References Cited

U.S. PATENT DOCUMENTS

| | | | | | |
|---|---|---|---|---|---|
| 2,809,416 | A | * | 10/1957 | Vincius | 27/17 |
| 2,811,768 | A | * | 11/1957 | Axelson | 27/7 |
| 3,997,948 | A | * | 12/1976 | Hicks et al. | 27/2 |
| 4,156,956 | A | * | 6/1979 | Partridge et al. | 27/4 |
| 4,867,327 | A | | 9/1989 | Roland | |
| 5,471,718 | A | * | 12/1995 | Harrill | 27/7 |
| 5,743,421 | A | | 4/1998 | Gonzalez et al. | |
| 6,018,853 | A | * | 2/2000 | Chen et al. | 27/2 |
| 6,138,335 | A | * | 10/2000 | Drawbaugh et al. | 27/10 |
| 6,314,626 | B1 | * | 11/2001 | Becker | 27/4 |
| 6,497,018 | B1 | | 12/2002 | Chiu et al. | |
| 7,213,311 | B2 | * | 5/2007 | Davis et al. | 27/2 |
| 7,222,400 | B2 | * | 5/2007 | Leverett | 27/19 |

FOREIGN PATENT DOCUMENTS

| | | |
|---|---|---|
| EP | 0 759 400 A2 | 2/1997 |
| FR | 2 745 547 A | 9/1997 |
| GB | 2 293 160 A | 3/1996 |

* cited by examiner

*Primary Examiner*—William L. Miller
(74) *Attorney, Agent, or Firm*—Ladas & Parry LLP

(57) ABSTRACT

Assembly for forming a box, comprising a bottom wall, two longitudinal walls, two end walls and an upper wall, wherein the walls are each plate-shaped and provided with coupling parts directly cooperating with each other and situated in the plane of the plate in question. All walls have been obtained from the same plate material.

23 Claims, 15 Drawing Sheets

BOX

FIELD OF INVENTION

The invention relates to a box or case, particularly to an assembly forming a kit for a box or case.

BACKGROUND OF INVENTION

There is a need for boxes which in disassembled condition can be kept ready and be transported on demand in compact condition to the location of use, in order to be easily assembled there.

For instance in case of calamities, such as natural disasters, war and the like, causing many victims, there is a need for having large numbers of coffins at one's disposal as soon as possible in order to be able to quickly remove and store the dead bodies in them.

Such calamities however, usually take place at locations far from the industrialised world or far from urbanisation. Making coffins in sufficiently large quantities in situ often is impossible, due to lack of machines, material (particularly wooden boards) and manpower.

With kits for boxes that are known per se boxes can be held in store at other locations and be dispatched on demand to the location of need such as a disaster area. A problem however is that the boxes then need to be assembled in situ for which skilled manpower and tools are necessary.

SUMMARY OF INVENTION

It is an object of the invention to provide an assembly for a coffin, which can easily be assembled in situ into a box, such as for instance a coffin.

A further object of the invention is to provide an assembly for a box, that can be stored and transported in a compact condition.

A further object of the invention is to provide an assembly for a box that is easy to make.

According to one aspect of the invention at least one of these objects is achieved by means of an assembly for forming a box, comprising a bottom wall, two longitudinal walls, two end walls and an upper wall, wherein the walls are each plate-shaped and provided with coupling parts directly cooperating with each other and situated in the plane of the plate in question.

For connecting the walls of the box to each other no extra connection means are necessary so that the walls can quickly be joined without tools into a box by almost anybody.

It is noted that the longitudinal walls may be longer than the end walls, but may optionally also be shorter than the end walls or be equally long as the longitudinal walls.

Preferably all said walls are obtained from the same plate material, so that the walls can simply be obtained from one type of plate, for instance by cutting.

In a further development of the assembly according to the invention, the cooperating coupling parts comprise first coupling portions on the one wall and second coupling portions on the other wall to be connected thereto, wherein the first coupling portions comprise slits extending through the plate in question and the second coupling portions comprise lips projecting from the edge of the plate in question, each of which lips with said edge define a slot accessible at one end. In this way a simple slide or shift connection is obtained. The box can be assembled quickly, easily and reliably.

Preferably the slits have a thickness corresponding with the thickness of the plate, due to which a snug fit is obtained which increases the stability of the connection.

In a further embodiment the slot defined by the edges and the lips has a width corresponding with the thickness of the plate, due to which a tight interengagement is realised.

Alternatively the slot defined by the edge and the lips may have a width that is smaller than the thickness of the plate, wherein the plate provided with the related slit is locally provided with a recess contiguous to the slit for accommodation of at least a portion of the lip. The lip then projects less far from the surface.

In one embodiment the bottom wall is provided with aforementioned—particularly equally oriented—lips. The longitudinal walls here are supported on the lips. This embodiment may advantageously be supplemented with the measure that the lips formed at the bottom wall also form a handle.

The longitudinal walls may be provided with slits for the lips on the bottom wall.

In a further development of the assembly according to the invention the end walls are provided with slits for cooperation with lips provided at the end edges of the longitudinal walls, which lips preferably with their open end are upwardly oriented. In this way the end walls can be easily lowered onto the end edges of the longitudinal walls.

In a further development of the assembly according to the invention the longitudinal walls are provided at their upper edges with—particularly equally oriented—lips and the upper wall is provided with slits cooperating therewith. The upper wall or lid wall as well can thus easily be placed.

In a further development of the assembly according to the invention at least two of the walls are connected/connectable to each other by means of a snap connection. The snap connection may comprise a lip forming one unity with the one wall and which is able to enter into a snap connection with a recess in the other wall, wherein the other wall near the recess is provided with a snap cam. The lip may, when effecting the snap connection, be resiliently deformable.

In a further development of the assembly according to the invention, the upper wall can be accommodated in a confined manner between both end walls, as a result of which said wall remains reliably in its place.

If the walls are perfectly flat, stacking the walls is enhanced and a package that is as flat and stable as possible can be obtained, which can be stacked properly.

From a further aspect the invention provides an assembly for forming a box, comprising a bottom wall, two longitudinal walls, two end walls and an upper wall, wherein the walls have each been made of the same plate material and are connectable to each other by means of a coupling which is created by sliding. It is preferred here that the walls are free from portions protruding from their main surfaces.

From a further aspect the invention provides a box assembled from the assembly according to the invention.

From a further aspect the invention provides a box designed for use as coffin.

BRIEF DESCRIPTION OF THE DRAWINGS

The invention will be elucidated on the basis of a number of exemplary embodiments shown in the drawings, in which.

DETAILED DESCRIPTION

Figure 1:
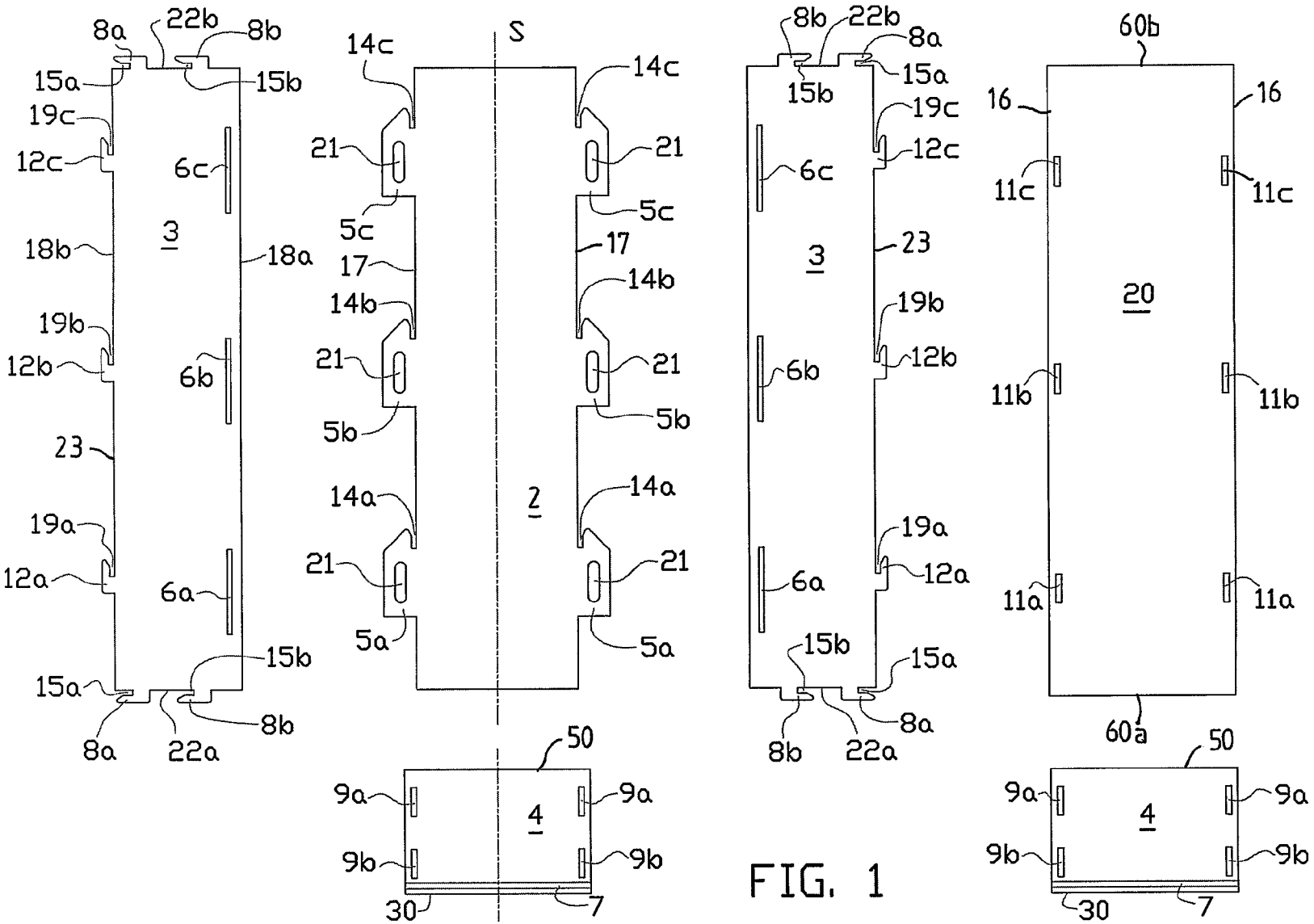
FIG. 1 shows a top view of an assembly of panels suitable for building a first exemplary embodiment of a box according to the invention.

The exemplary embodiment shown in the FIGS. 1-5 of a box 1 according to the invention comprises a bottom panel 2, two side panels 3, 3, two end panels 4, 4 and an upper panel or lid 20. The box 1 has the dimensions to be used as a coffin.

The plate material of which the panels 2, 3, 3, 4, 4 and 20 have been made may for instance be MDF plate material. Water-resistant multiplex can also be used, or other plate materials, that can be cut or sawn and preferably are resistant to weather conditions. The panels may be obtained from the same plate material.

At its longitudinal edges the bottom panel 2 is provided with, in this example, three handle parts 5*a*, 5*b*, 5*c* that have through-holes 21 for engagement by a hand and together with the said longitudinal edge 17 of bottom panel 2 define a slot 14*a*, 14*b*, 14*c* each time equally oriented and provided with an open end. The holes 21, which may for that matter also be used for passing through of a hoist sling, are spaced apart from a notional line coinciding with the edge 17, as a result of which the transfer of forces to the bottom panel 2 is improved.

The side panels 3 are identical and near the lower edge are provided with three slit-shaped openings 6*a*, 6*b*, 6*c* having a slit height corresponding with the thickness of the plate material from which the panels 2, 3, 3, 4, 4 and 20 have been obtained. The length of the slits 6*a*, 6*b* and 6*c* corresponds with the length of the related handles 5*a*, 5*b* and 5*c*.

At the upper edge the side panels 3, 3 are provided with equally oriented, hook-shaped lips 12*a*, 12*b*, 12*c*, which leave a slot 19*a*, 19*b*, 19*c* with the upper edge 18*b* of side panels 3, 3. The width of the slots 19*a-c* corresponds with the thickness of the plate material.

At the end edges 22*a* and 22*b* similar, equally oriented (upwards) lips 8*a*, 8*b* are provided, which with the edges 22*a*, 22*b* define slots 15*a*, 15*b* of which the width corresponds again with the thickness of the plate material.

Note that the ends of the lips 12*a-c* and 8*a*, 8*b* are bevelled with pilot edges.

The end panels 4, 4 are provided with slits 9*a*, 9*b* adjusted to the lips 8*a*, 8*b*, wherein the length of the slits 9*a*, 9*b* corresponds with the length of the lips 8*a*, 8*b*. The panels 4, 4 are symmetrical: at the opposite edges the same lips are present.

Near the longitudinal edges 16 the lid 20 is provided with slits 11*a, b, c*, for cooperation with the lips 12*a*, 12*b*, 12*c*. The length of the slits 11*a-c* corresponds with the largest length of the lips 12*a-c*. The width of the slits 11*a-c* corresponds with the thickness of the plate material.

Figure 2:
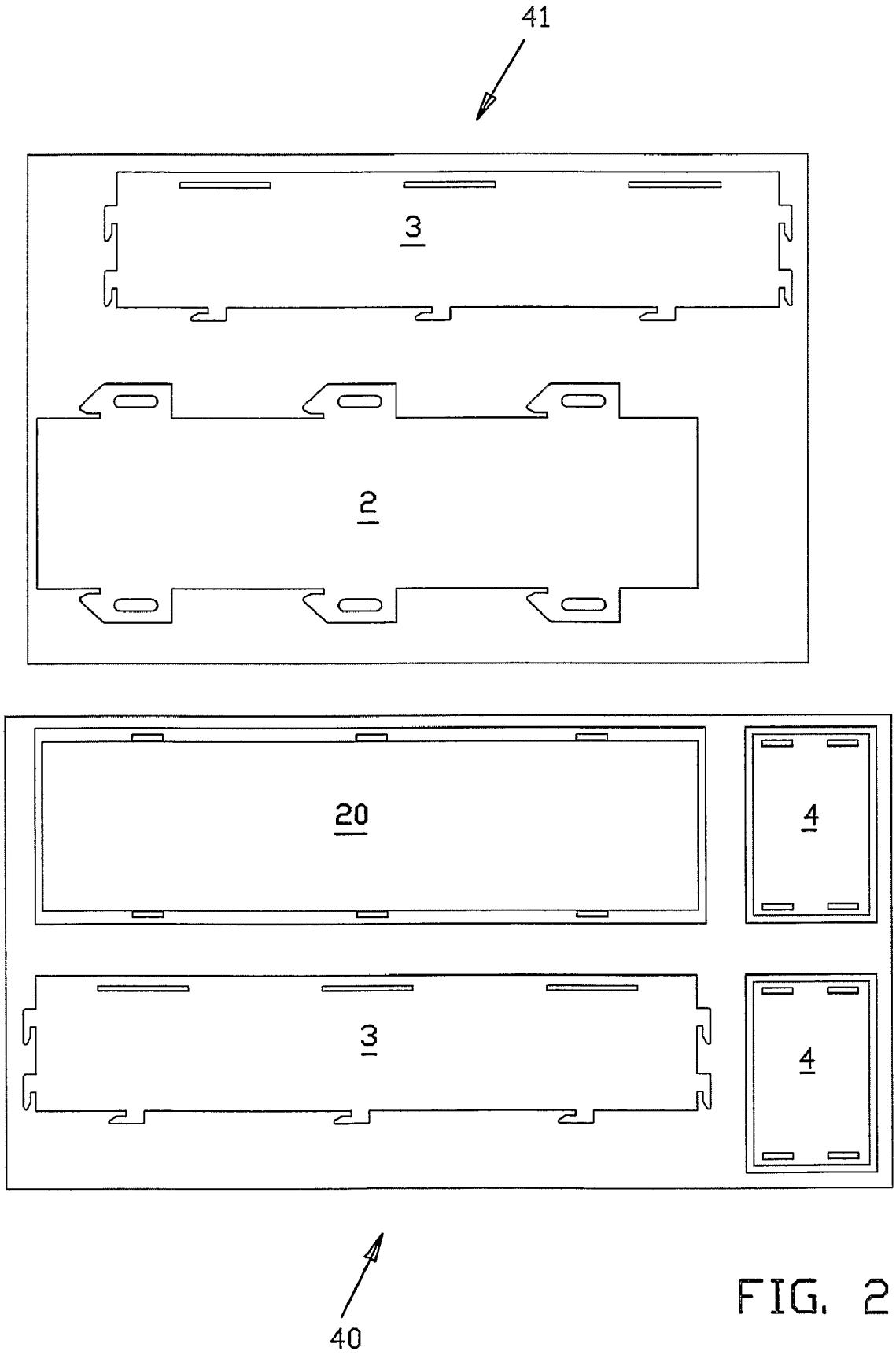
FIG. 2 shows the panels shown in FIG. 1 placed adjacent to each other.

The panels 2, 3, 3, 4, 4 and 20 shown in FIG. 1 can be transported and kept in store in stacked package condition. A package for a box 1 may consist of two package layers, such as shown in FIG. 2. The first package layer 40 contains the lid/upper panel 20, one side panel 3, and two end panels 4. The second package layer 41 contains the bottom panel 2 and one side panel 3. Both package layers 40, 41 can be stacked onto each other. With exemplary dimensions of 710×1950 mm for the bottom panel 2, 390×1950 mm for the side panels 3, 590×390 mm for the end panels and 580×1976 mm for the lid, the dimensions b×l of the package layers 40, 41 can be 1200×2500 mm. Packages for several boxes 1 can easily be strapped up using bands or be wrapped in shrink foil.

The package thus obtained can easily be transported to the location of use while taking up little space. An airplane can for instance be loaded with such packages, if somewhere far away in the world a calamity has occurred, causing many casualties.

In the area of use a truck can easily transport the packages further to the location of use.

Figure 3:
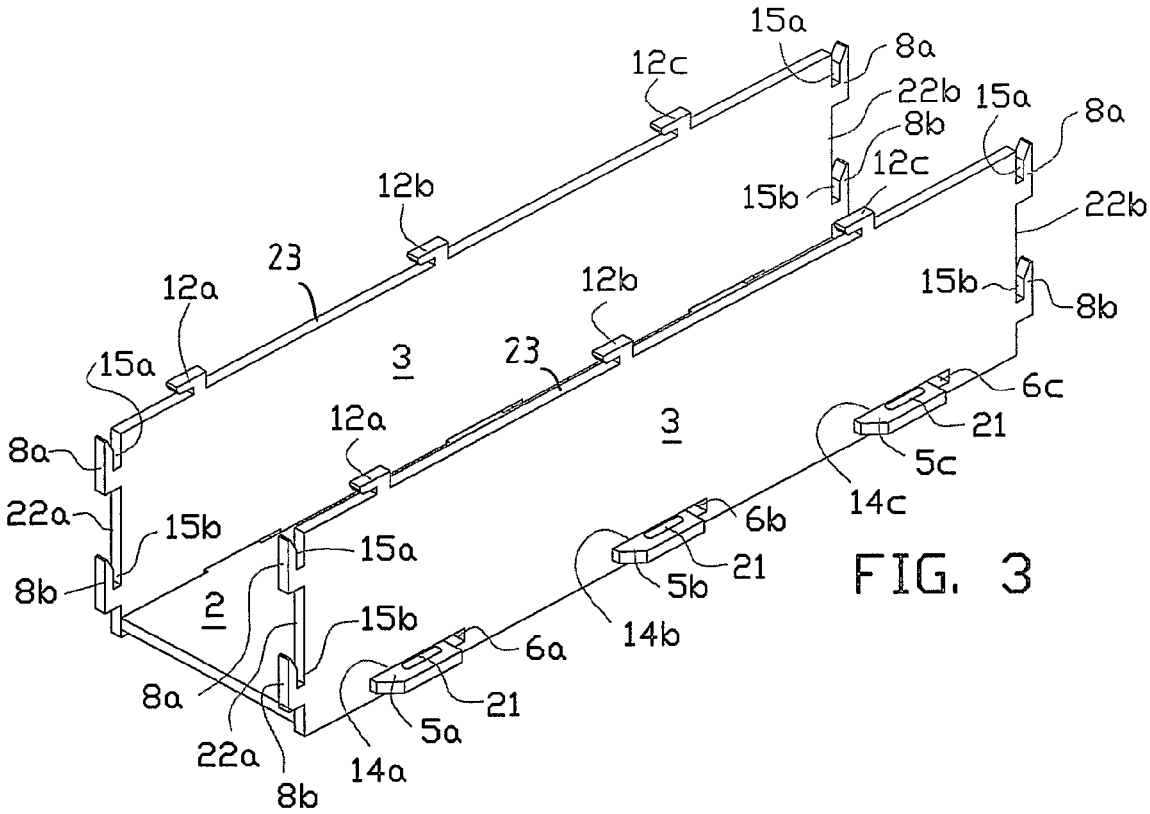
FIG. 3 shows the exemplary embodiment of the box according to FIG. 1, in a first stage of assembling.

At the location of use the package is opened, and the bottom panel 2 is laid on the floor. Subsequently the side panels 3, 3 are brought to the edges 17, such that the handles 5*a*, 5*b*, 5*c* extend in the slits 6*a*, 6*b*, 6*c*. When the side panels 3, 3 abut the edges 17 the side panels 3, 3 can be slid along the edges 17, wherein the slots 14*a*, 14*b*, 14*c* accommodate the material of the side walls 3, 3. After this sliding the end edges 22*a*, 22*b* of the side panels 3*a*, 3*b* are in one vertical plane with the end edges of the bottom panel 2 (FIG. 3). The handles 5*a-c* and the lips 12*a-c* extend in the same direction with their free ends.

Figure 4:
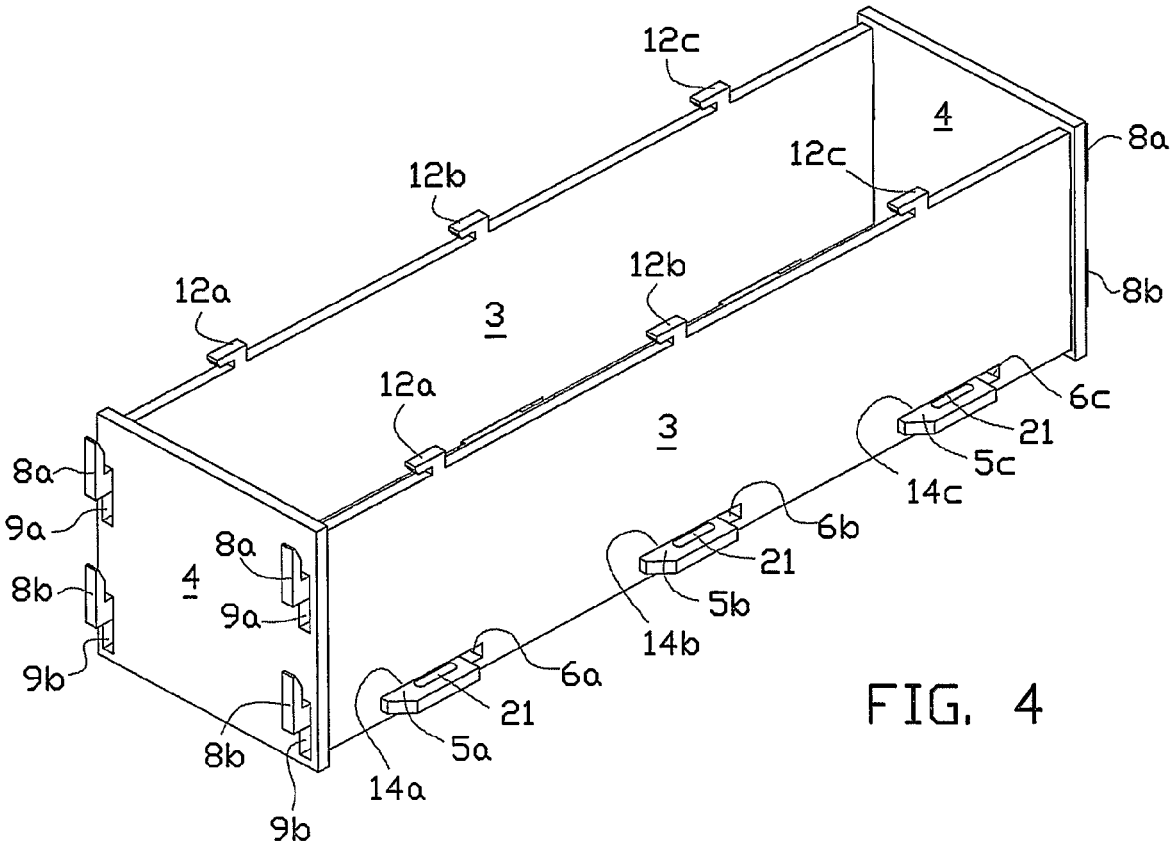
FIG. 4 shows the box of FIG. 1, in a second stage of assembling.

Subsequently (FIG. 3) the end panels 4, 4 are arranged, wherein while holding them vertically, the slits 9*a*, 9*b* are placed over the lips 8*a*, 8*b*. Then the end panels 4, 4 are lowered, wherein the material of said panels is accommodated in the slots 15*a*, 15*b*. Finally the upper edge of the end walls 4, 4 is at least almost in one plane with the upper edges 18*b* of the side panels 3, 3 (FIG. 4).

Figure 5:
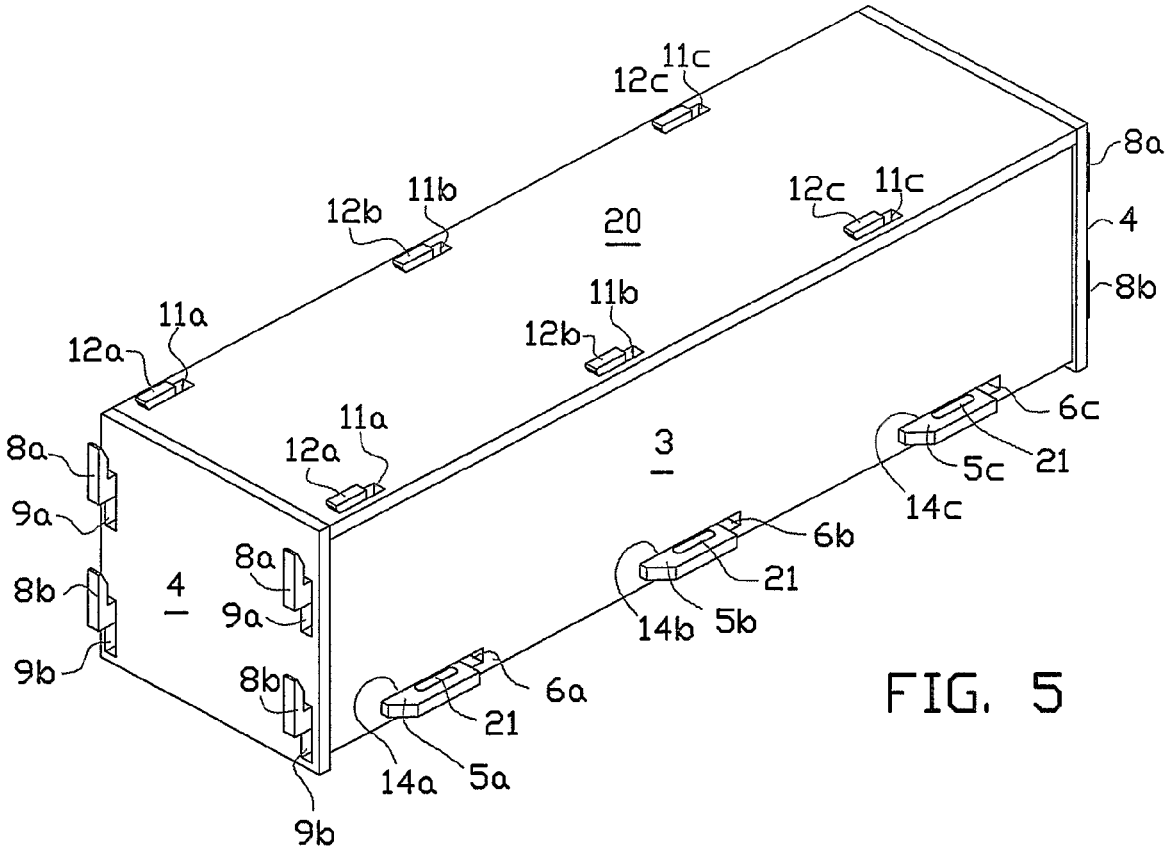
FIG. 5 shows the box of FIG. 1, in closed condition.

An open box is formed in this way in which a body can be placed. After this is done the lid 20 is taken and placed with the slits 11*a, b, c* on the lips 12*a, b* and *c* of the side panels 3, 3, wherein the lid 20 will support on the upper edges 18*b* thereof. Subsequently the lid is shifted in longitudinal direction so that its material is accommodated in the slots 19*a, b, c*. After shifting the lid 20 covers the entire upper opening of the box 1, and its end edges are near the upper edges of the end panels 4, 4 (FIG. 5).

Figure 6A:
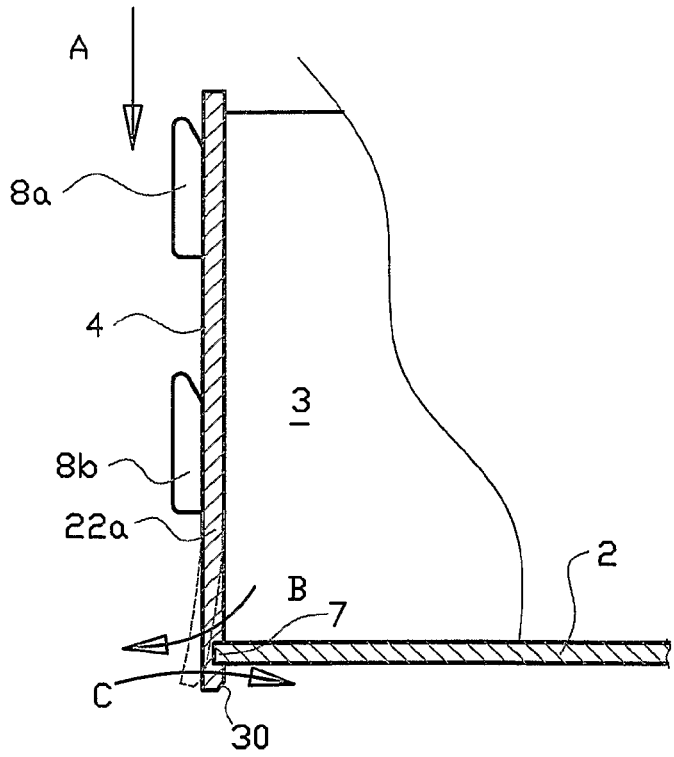
FIGS. 6A and 6B show some details of corner connections at the location of the bottom wall-end wall and upper wall-end wall, respectively.

In FIG. 6A the joining of the end walls 4 on the assembly of FIG. 3 is shown in further detail. The end walls 4 are moved downwards in the direction A, wherein the lips 8*a*, 8*b* extend in the slits 9*a*, 9*b*. At its lower end the end wall 4 is provided with a pilot edge 30, and above it with a groove 7 having a dimension corresponding with the thickness of the bottom wall 2.

In the movement in the direction A, first the pilot edge 30 will abut the edge of the bottom wall 2, and be able to deflect in the direction B, as a result of suitable flexibility of the plate material of the end walls 4. When the groove 7 has arrived at the location of the edge of the bottom wall 2, the lowermost edge portion of the end wall 4 is able to move back in the direction C, creating a kind of snap connection.

Figure 6B:
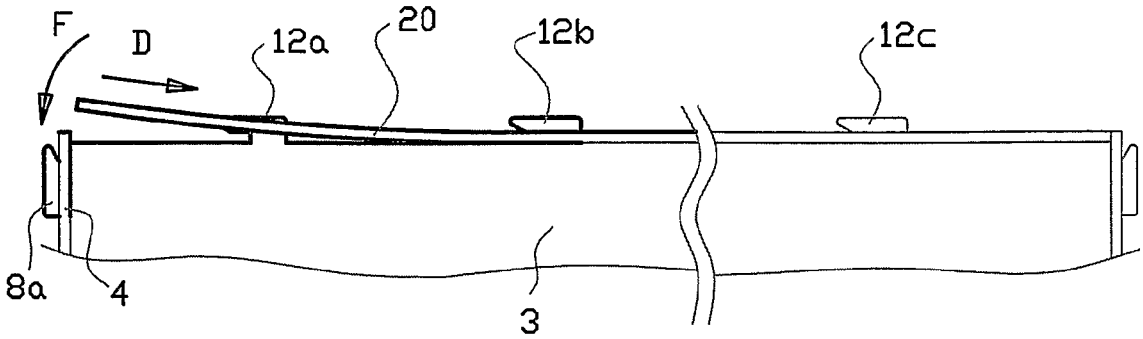

In FIG. 6B it is further elucidated how the upper wall or the lid 20 is arranged on the assembly of FIG. 4. The length of the upper wall 20 corresponds with the inside distance between the end walls 4. When placing the upper wall 20 over the lips 12*a-c*, with the slits 11*a-c*, the right-hand end edge 60*a* of the upper wall 20 will able to support on the upper edges 23 of the side walls 3. The left-hand end portion of the upper wall 20, as considered in the drawing, may support on the upper edge 50 of the end wall 4. The upper wall 20 can then be pushed up in the direction D, to the right, wherein the portion between the lips 12*a* and the left end will become slightly bent, which is made possible by a suitable choice of the plate material. As soon as the left end edge 60*b* of the upper wall 20 has been moved past the upper wall of the end wall 4, this portion will be able to bend back in the direction F, after which both end edges 60*a*, 60*b* of the upper wall 20 are more or less exactly confined between the end walls 4. Should temporary access to the box be necessary, then the left end portion of the upper wall 20, as considered in the drawing of FIG. 6B, can be engaged along the side walls by the hands in order to slightly lift it, and then sliding back the upper wall 20 in one direction opposite to D in order to subsequently remove it.

Due to adjusting the dimension of the width of the various slots and the width of the slits and the thickness of the plate material, firm connections are realised as a result of which the box 1 created in the end can reliably be handled as one unity. No additional fastening means are necessary so that no tools are necessary either. Building the box 1 requires no particular skill.

As the lips and handles are in one plane with the plate material with which they form one unity, the box 1 is built up from six flat plates and the volume and the shape of a stacked package can remain small.

It is noted that the walls, particularly the upper wall, can be split. In case of a split upper wall for instance a part of ¾ of the usual length and a part of ¼ of the usual length can be used. By temporarily leaving out the shorter part it is possible at the location of the head end to provide the opportunity to see the head of the deceased person lying in the box.

Figure 7A:
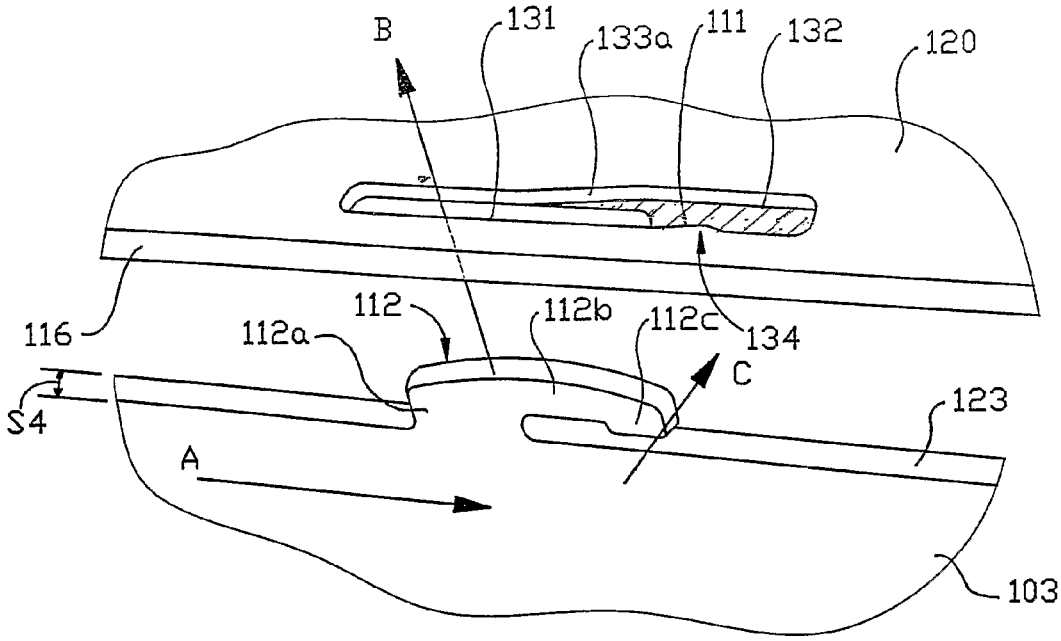
FIG. 7A shows a view in perspective of an assembly of an upper plate having an elongated hole and a bottom plate having a hook for forming a snap connection, in unconnected condition.
Figure 7B:
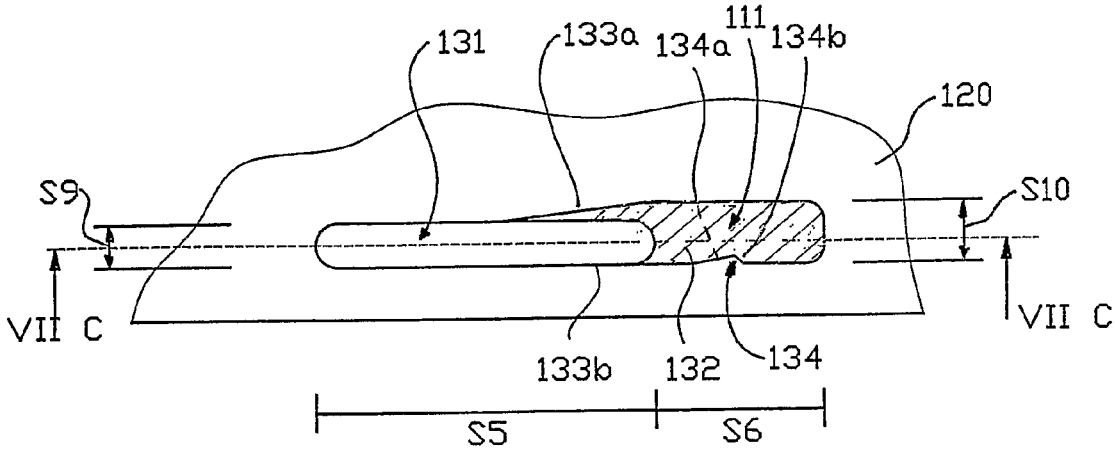
FIG. 7B shows a top view of the upper plate according to FIG. 7A.
Figure 7C:
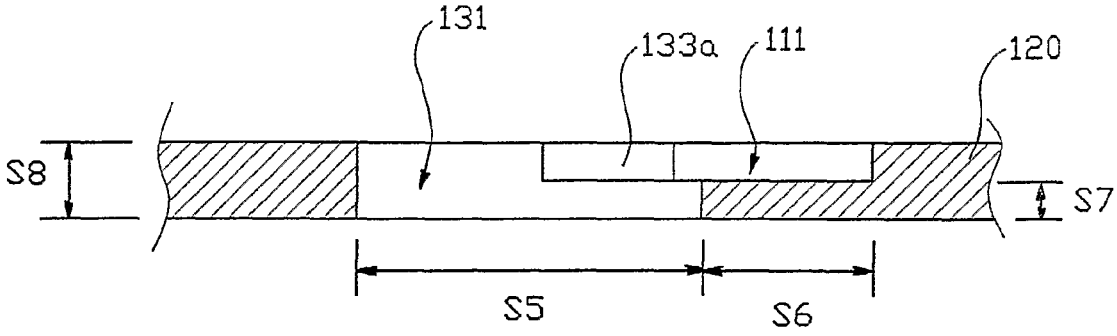
FIG. 7C shows a cross-section of the upper plate according to line VIIC-VIIC in FIG. 7B.
Figure 7D:
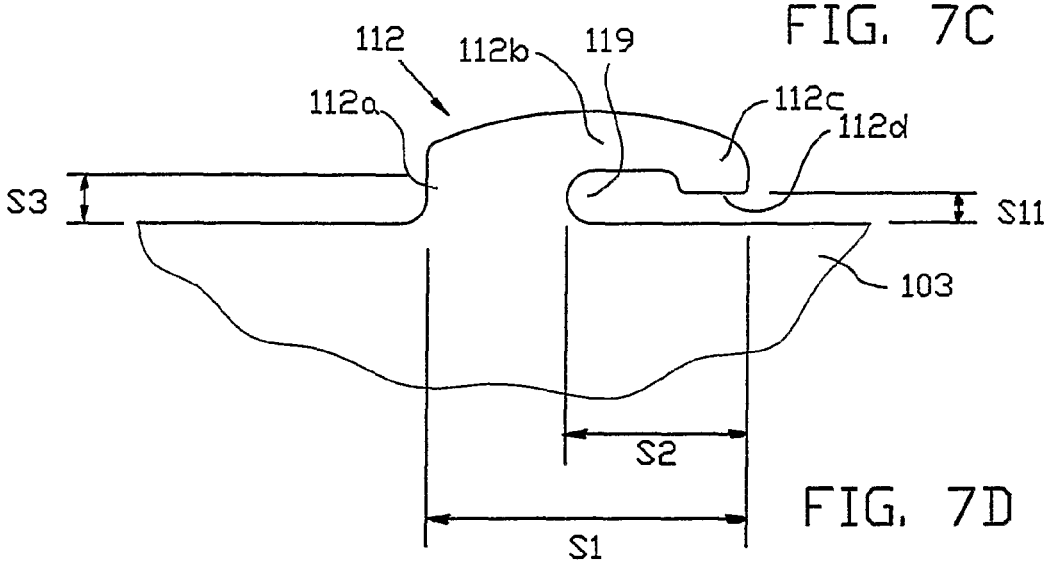
FIG. 7D shows a side view of the bottom plate with hook according to FIG. 7A.

FIGS. 7A up to and including 7H show an example of a snap connection for a box according to the invention. The upper panel 120 (first plate) and a side panel 103 (second plate) according to the invention. The upper panel 120 is provided with a slit 111. A through elongated hole 131 (first recess) is formed in the slit 111. In the prolongation of the elongated hole 131 the bottom of the slit 111 forms a supporting plane 132. The elongated hole 131 has a length S5, and the supporting plane has a length S6. The elongated hole 131 has a width S9 and the slit has a width S10 at the supporting plane 132. The upper plate has a thickness S8. The supporting plane 132 is parallel to a lower side of the upper panel 120 at a height S7. As a result the supporting plane 132 is easy to make using a machine.

The side panel 103 is provided with a squared side edge 123 to which at least one hook 112 (hook part) is formed. The hook 112 has a first wider section 112*a* and, considered in a direction A thereof, a narrower centre section 112*b* and an end 112*c*, respectively. At the end 112*c* an abutment surface has been formed that is parallel to the side edge 123 of the side panel 103. The hook 112 has a length S1 in the direction A. Between the centre section 112*b* and the end 112*c* of the hook 112 on the one hand, and the side edge 123 of the side panel 103 on the other hand an accommodation aperture 119 is defined having a length S2. The accommodation aperture 119 has a height S3 underneath the centre section 112*b* and a height S11 underneath the end 112*c*. The side panel 103 has a thickness S4.

The hook 112 can be inserted through the elongated hole 131 in a direction B. The centre section 112*b* and the end 112*c* of the hook 112 are elastically deformable in direction C transverse to the side panel 103.

The length S5 of the elongated hole 132 is larger than the length S1 of the hook 112. The width S9 of the elongated hole 132 is larger than the thickness S4 of the side panel 103, wherein the width S9 is such that the hook 112 is able to abut the longitudinal walls 133*a, b* of the elongated hole 131. In this case the hook 112 is able to slide in the direction A in the elongated hole 131.

The length S6 of the supporting plane 132 for instance almost equals the length S2 of the accommodation aperture 119. The height S3 of the accommodation aperture 119 of the hook 112 almost equals the thickness S8 of the upper panel 120. The height S11 of the accommodation aperture 119 of the hook 112 almost equals the height S7 of the supporting plane 132. The width S10 of the slit 111 is larger than the width S9 of the elongated hole 132.

At one longitudinal wall 133*a* of the slit 111, at the level of the supporting plane 132 a cam 134 (snap cam) is situated, which extends transverse into the slit 111. Considered in the direction A the cam 134 has an upwardly sloping section 134*a* extending in the slit 111 and contiguously a steeper downwardly sloping section 134*b*.

The consecutive steps to bring the upper panel 120 and the side panel 103 in a mutual connection at right angles are shown consecutively in FIGS. 7A, 7E-H.

Figure 7E:
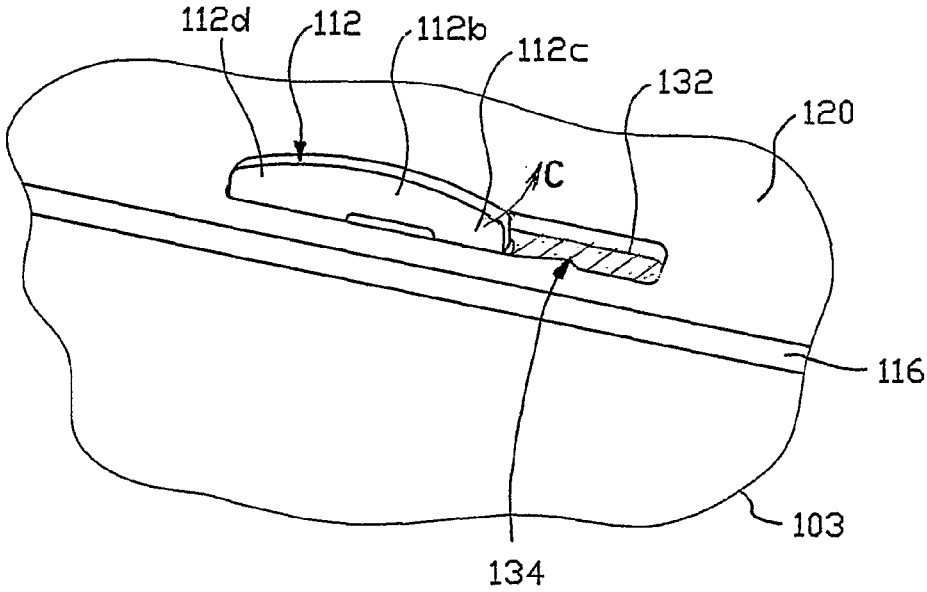
FIG. 7E shows the first assembly according to FIG. 7A, wherein the upper plate is situated on the bottom plate.

In FIG. 7A the upper panel 120 and the side panel 103 are positioned mutually perpendicular above each other, so that the hook 112 can be inserted through the elongated hole 131 in the direction B, as a result of which the upper panel 120 with its lower side abuts on the side edge 123 of the side panel 103. This is shown in FIG. 7E.

Figure 7F:
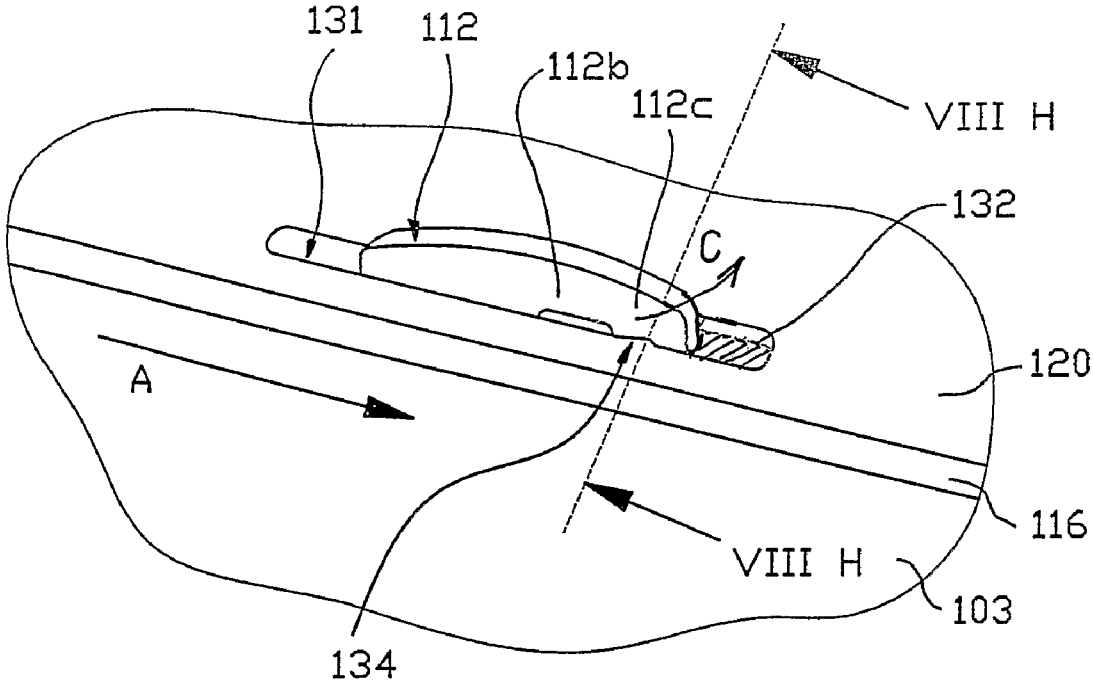
FIG. 7F shows the first assembly according to FIG. 7A, in partially connected condition.

Subsequently, as shown in FIG. 7F, the side panel 103 is shifted with respect to the upper panel 120 in the direction of arrow A, as a result of which the end 112*c* of the hook 112 with abutment surface 112*d* will come into engagement with the supporting plane 132 in the slit 111. During this shifting the end 112*c* of the hook 112 is moved in the direction C by the cam 134, wherein the centre section 112*b* elastically bends in direction C. The moved position of the end 112*c* of the hook 112 is shown in cross-section in FIG. 7H.

Figure 7G:
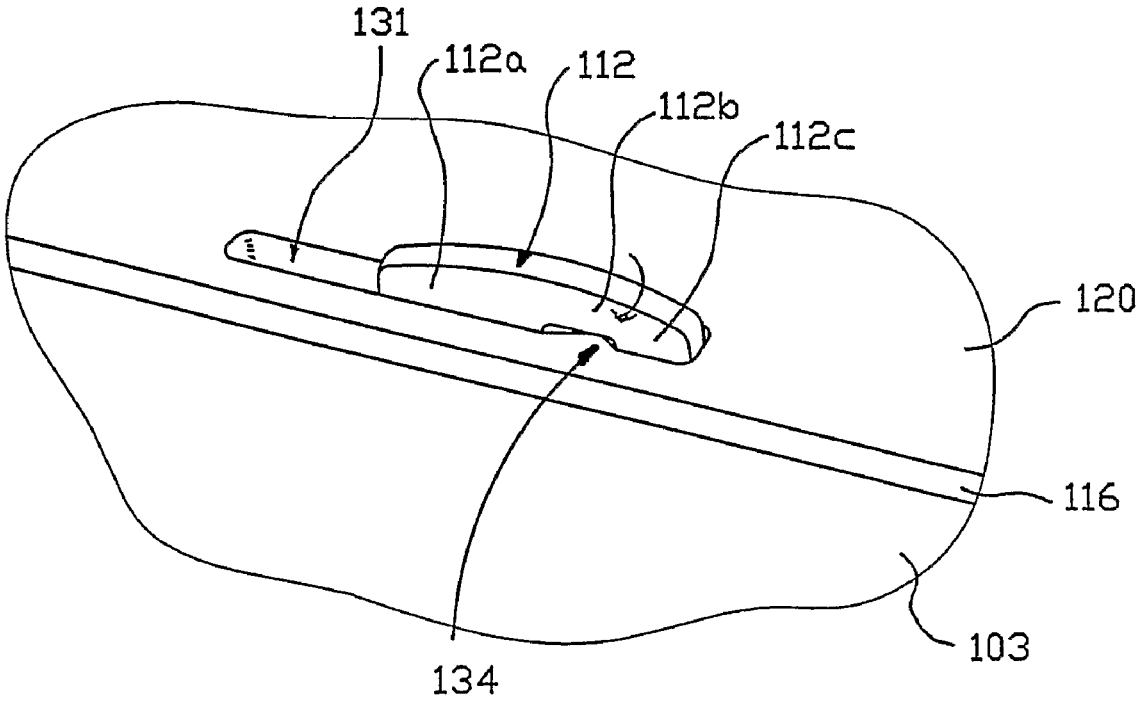
FIG. 7G shows the first assembly according to FIG. 7A, in fully connected condition.
Figure 7H:
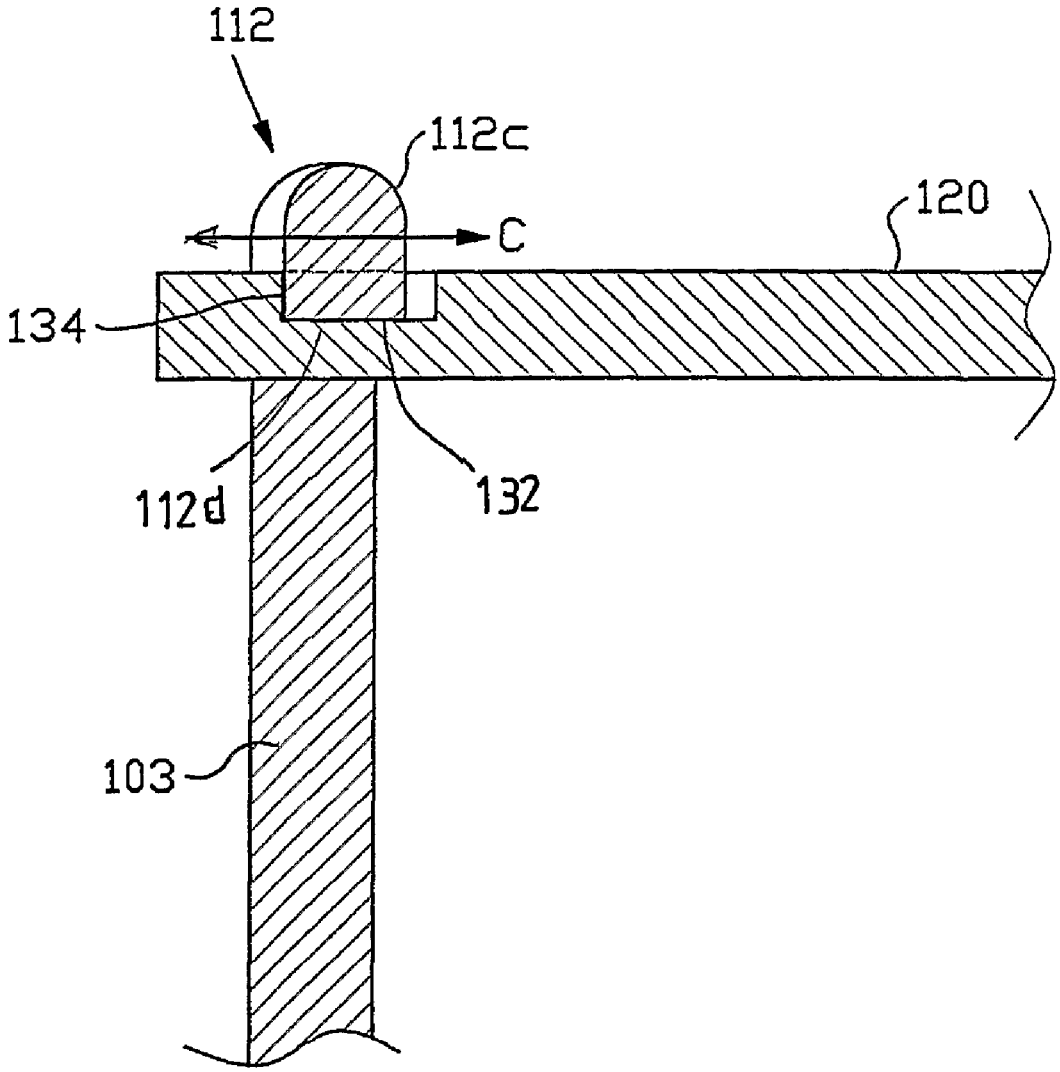
FIG. 7H shows a cross-section of the first assembly according to line VIIH-VIIH in FIG. 7F.

Subsequently due to moving the side panel 103 further in the direction A, the end 112*c* of the hook 112 is slid to beyond the cam 134 as a result of which the end 112*c* of the hook 112 moves back while elastically moving back the centre section 112*b*. This is shown in FIG. 7G. In this way the centre section 112*b* of the hook 112 will abut upper panel 120 at the level of the cam 134.

In this shown example the downwardly sloping section 134*b* of the cam 134 is formed by a plane that is at an obtuse angle to the longitudinal wall 133*b*. In this way the connection can be ended again due to the side panel 103 moving back. The plane of the downwardly sloping section 134*b* may alternatively also be perpendicular or at an acute angle to the longitudinal wall 133*b*, as a result of which a self-locking connection is achieved as moving back in opposite direction to A is blocked.

Figure 8A:
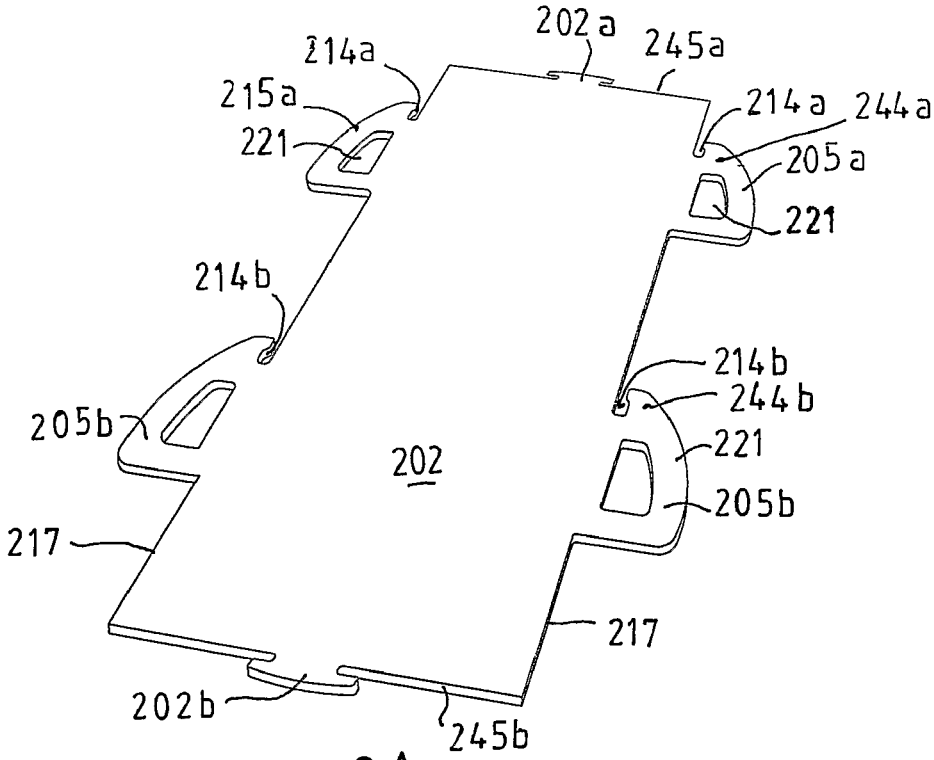
FIGS. 8A-F show consecutive steps in assembling a second exemplary embodiment of a box according to the invention.
Figure 8B:
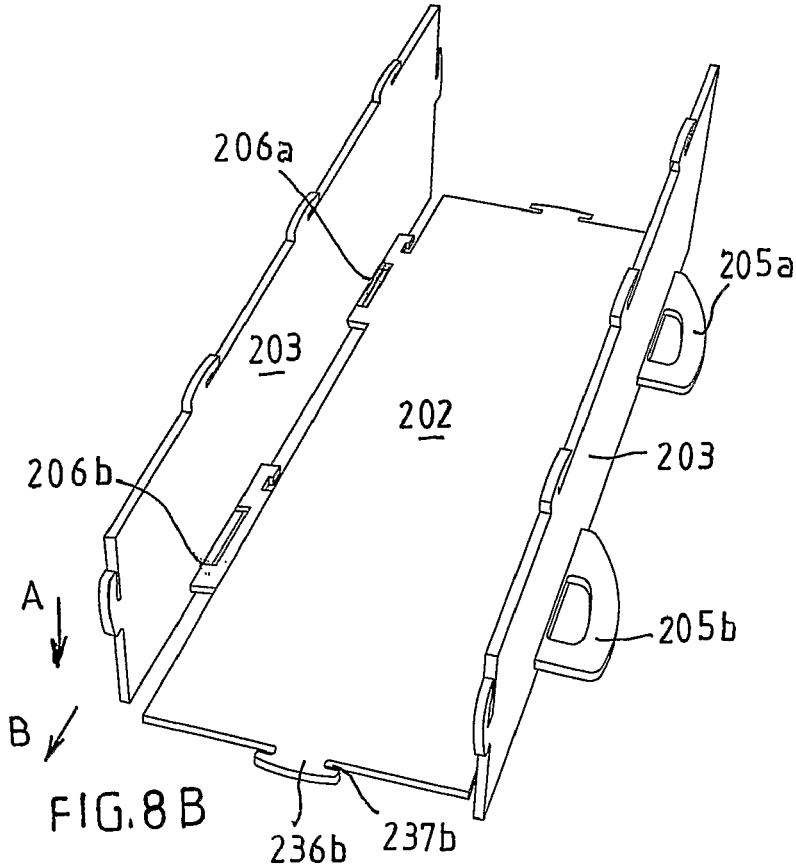
Figure 8C:
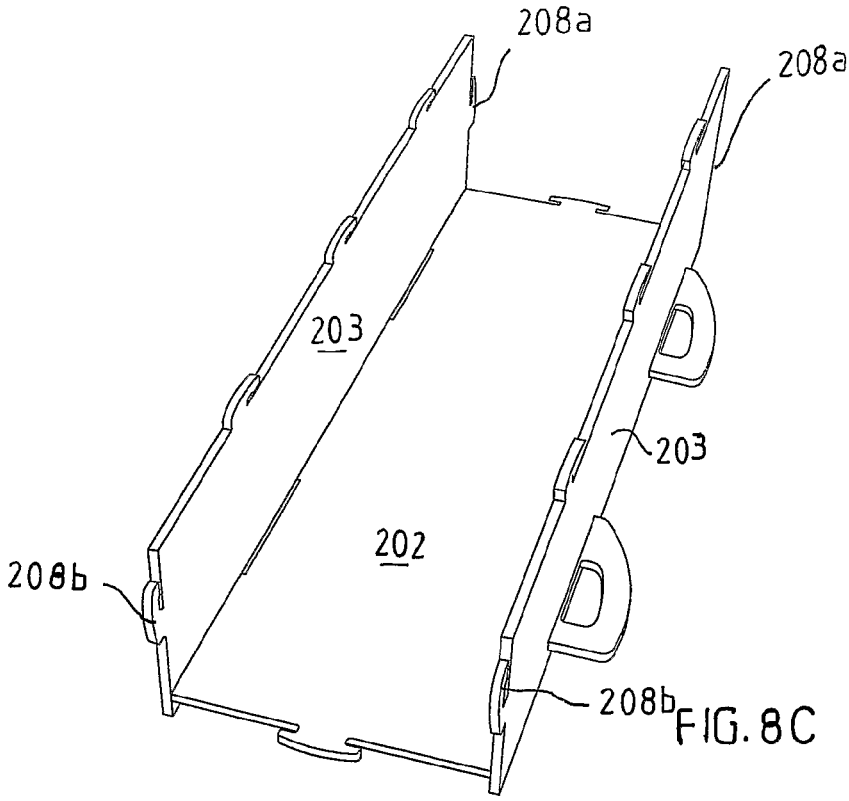
Figure 8D:
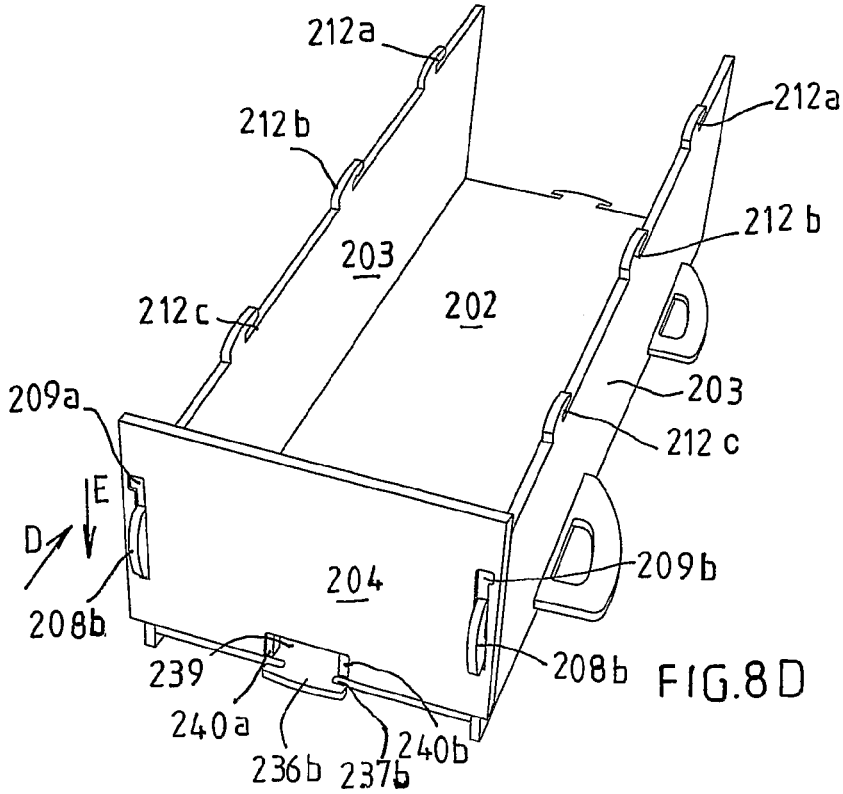
Figure 8F:
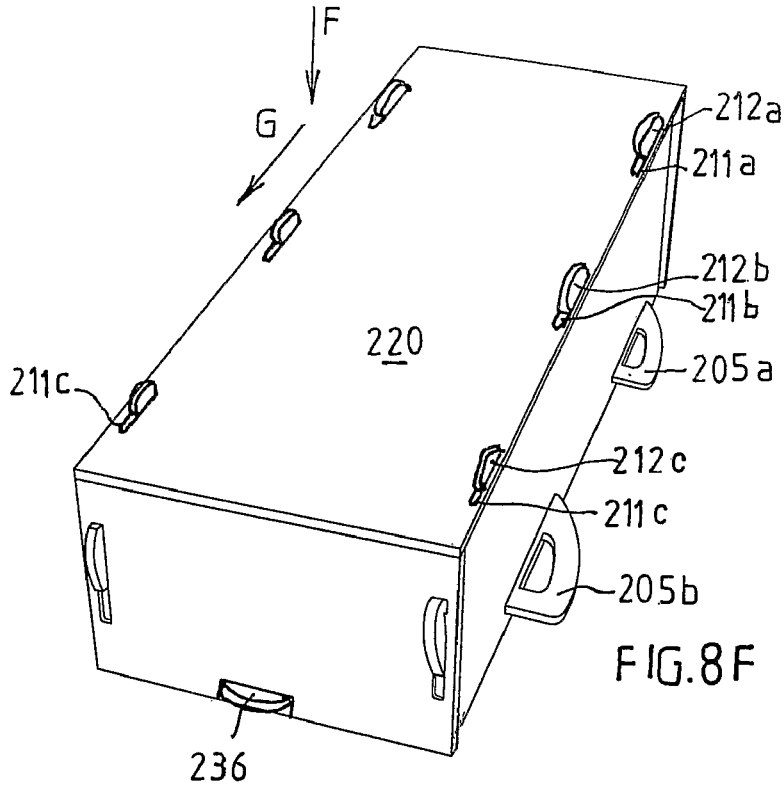
Figure 8E:
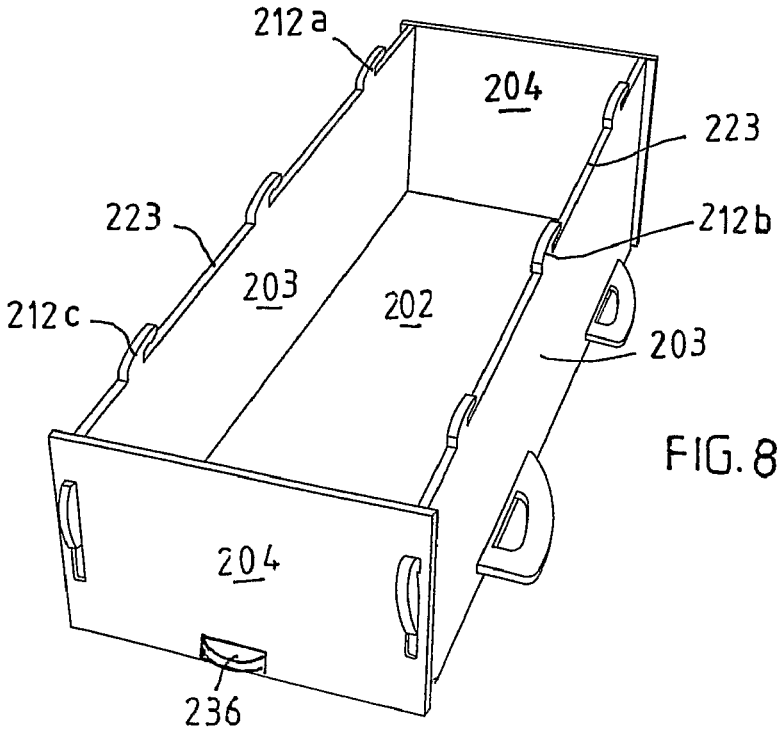
Figure 9:
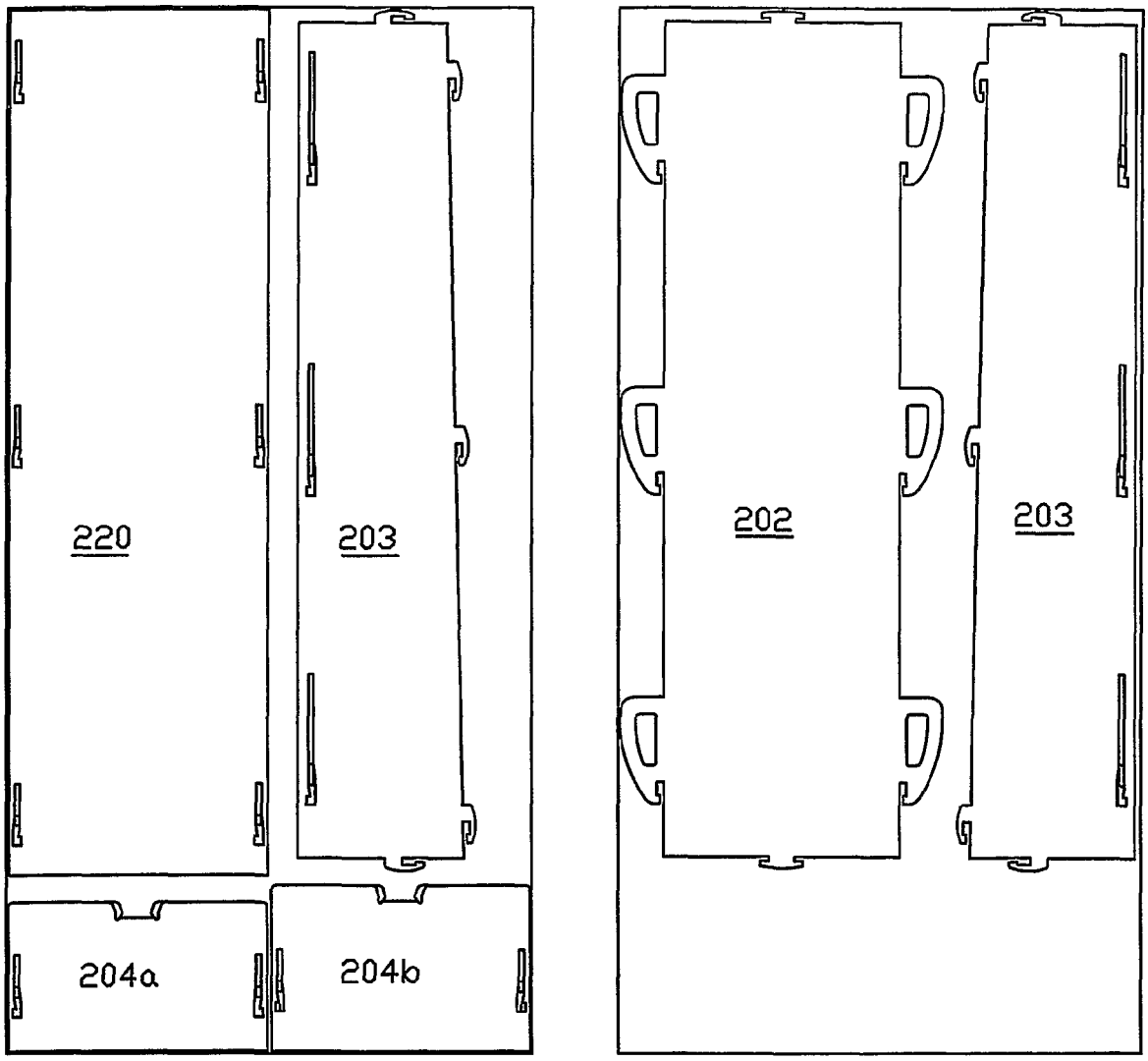
FIG. 9 shows a top view of an assembly of panels suitable for assembling the second exemplary embodiment of the box according to FIGS. 8A-I.

The embodiment of a coffin/box according to the invention shown in FIGS. 8A-F, comprises a bottom panel 202, side panels 203, end panels 204 and upper panel lid 220, also see FIG. 9. All panels may have the same thickness and may originate from the same plate material. They are free from parts projecting from above or underneath the main surfaces of the panels.

The bottom panel 202 shown in FIG. 8A in this example has four handles 205*a, b* each having a through-hole 221 and lips 244*a, b* which with the longitudinal edges 217 define slots 214*a, b*, wherein the lips 244*a, b* can be resiliently bend aside with respect to the main plane of the bottom panel 202, in the way as described in connection with FIGS. 7A-H above.

The end edges 245*a, b* are provided with T-shaped protrusions 236*a, b* that on either side with the end edges 245*a, b* define slots 237*a, b*.

In FIG. 8B already one panel 203 has been placed and the other side panel 203 is being placed. The side panel 203 is first moved in sideward direction A towards the side edge 217 in question of bottom panel 202, wherein the handles 205*a, b* will extend through the slits 206*a, b* made in the side panels 203. When the side panels 203 have abutted the side edges 217 the side panel 203 is shifted in the direction B along the side edge 217. The slits 206*a, b* have been formed in accordance with the slits 111 of the snap connection of the FIGS. 7A-H. When shifting in the direction B therefore a comparable snap connection will be created, wherein the resilient lips 244*a, b* will for a short while be bent aside out of their plane and then spring back in order to be locked behind said cam. The result of bottom panel 202 and two side panels 203 is shown in FIG. 8C.

Subsequently the end panels 204*a, b* are placed. A detail of an end panel 204 is shown in FIG. 8H. It shows a part of the lower edge of an end panel 204, provided with a recess 239, which is bounded by a step-shaped edge, as a result of which a lowering 240*a, b* has been formed. The lowered areas 240*a, b* form an accommodation space for a part of the protruding arms of the T-shaped protrusion 236*a, b*. Accordingly the slot 237*a, b*, also shown in FIG. 8I, is less wide than the thickness of the end panel 204.

At the end edges the side panels 203 are provided with lips 208*a, b* which lips correspond with the lips 112 of the snap connection shown in the FIGS. 7A-H. Likewise the end panels 204 are provided with slits 209*a, b* that correspond with the slits 111 of the snap connection shown in the FIGS. 7A-H.

When placing the end panels 204 they are first erected in the direction D, wherein the lips 208*a*, 209*b* extend through the slits 209*a, b*.

Subsequently the end panels 204 are shifted downwards in the direction E, wherein in the manner discussed above a snap connection is realised with the lips 208*a*, 208*b* and also the arms of the T-shaped protrusion 236*b* are accommodated (in this case) in the accommodation spaces formed by the lowerings 240*a, b* (FIG. 8D). Due to the T-shaped protrusion 236 a movement of the lower edge of the end panel 204 with respect to the end edge 245*b* of the bottom panel 202 is prevented, so that no undesirable slit space may be arise at that location.

After placing the other end panel 204 the situation shown in FIG. 8E is reached. After, in case of a coffin, the corpse has been laid in the box shown in FIG. 8E, the lid 220 can be placed. The lid 220 is provided with a number of slits 211*a, b, c*, corresponding with slit 111 of the snap connection shown in the FIGS. 7A-H. Likewise the upper edges 223 of the side panels 203 are provided with lips 212, corresponding with lips 112 of the snap connection shown in FIGS. 7A-H. Deviating from the embodiment shown in FIGS. 1-6B, the length of the lid 220 is such that the lid 220 will be able to support on the upper edges of the end panels 204 and on the upper edges 223 of the side panels 203.

The lid 220 is lowered in the direction F, wherein the slits 211*a-c* move downwards over the lips 112*a-c* and accommodate them. After the lid 220 supports on the upper edges of the side panels 203 and end panels 204 the lid 220 is shifted in the direction G, in longitudinal direction of the upper edges 223, until the said snap connections have been realised and the lid 220 is locked.

Figure 8G:
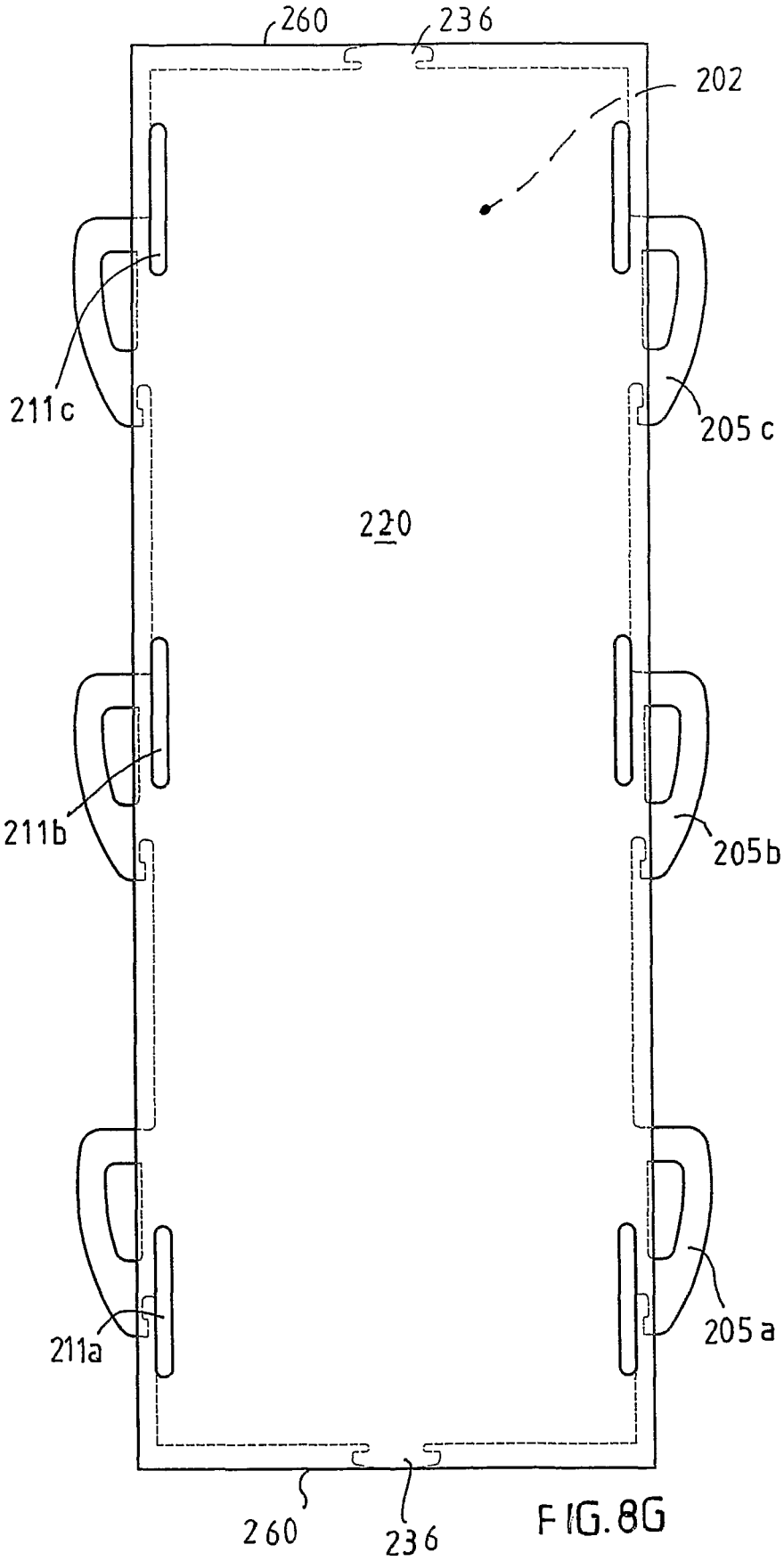
FIG. 8G shows a top view of a kit for a box comparable to the one of FIGS. 8A-F.
Figure 8H:
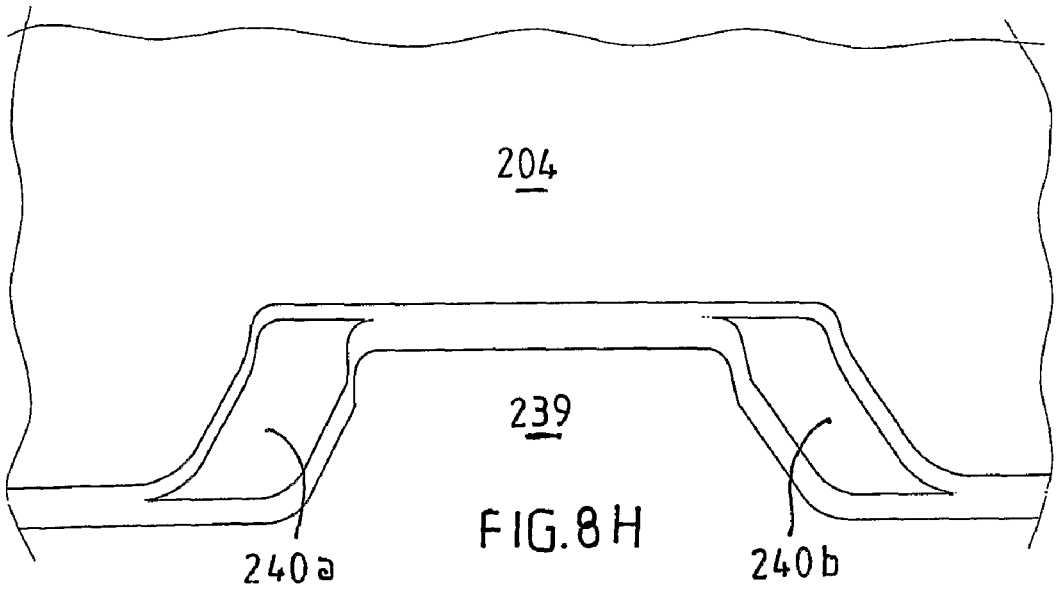
FIGS. 8H and 8I show details of two panels in the box of FIGS. 8A-F.
Figure 8I:
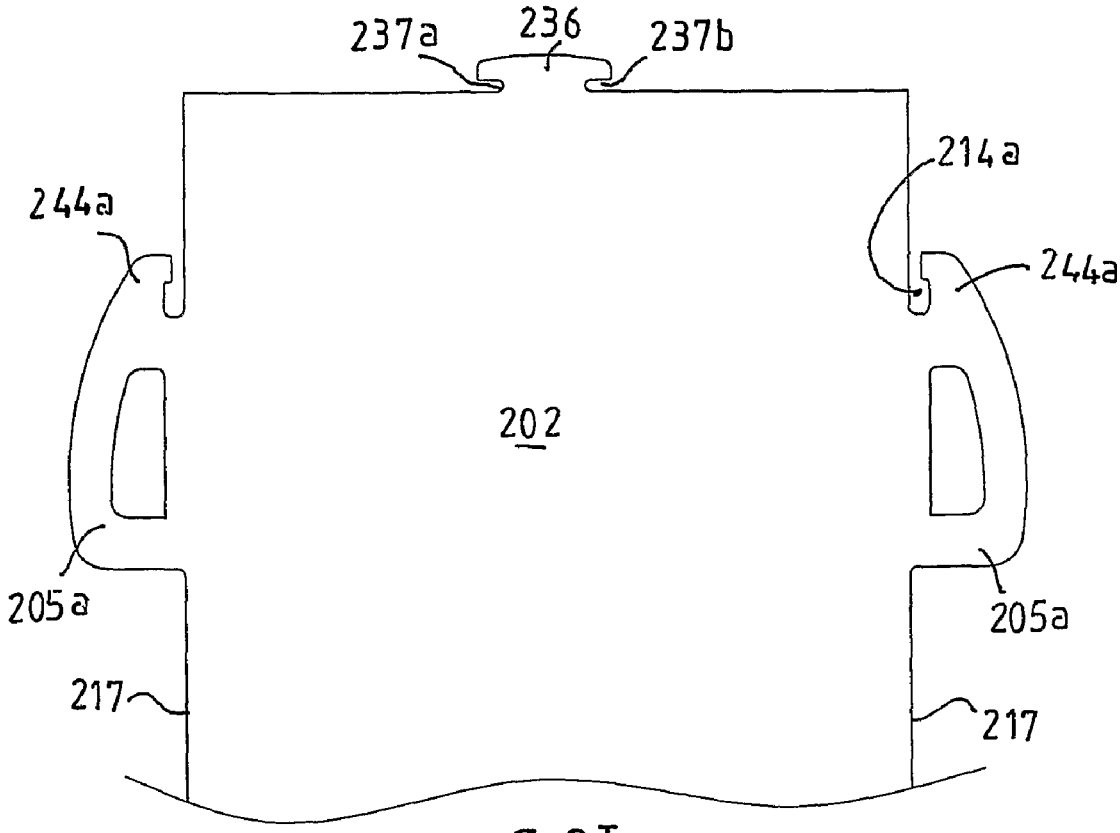

FIG. 8G shows a top view of a stack of panels shown in FIG. 9. It can be seen that the T-shaped protrusions 236*a, b* are shielded upwards and sidewards by the lid 220. The side panels and end panels are not shown, yet they are situated between the bottom panel 202 and the lid 220. The whole can be packed in a shrink foil (not shown).

It is noted that for the locking of the various panels it will not be necessary to design all interengaging parts as a snap connection. For instance one snap connection may suffice for the lid 220, whereas the other connections can be designed like those of the embodiment according to FIGS. 1-6B. Optionally one snap connection may be provided on both longitudinal sides.

What is claimed is:

1. A coffin for a deceased, comprising a bottom wall, two longitudinal walls, two end walls and an upper wall cooperating to define an interior for storing the deceased, wherein each of the walls is plate-shaped and defines a plane, each of at least a first and a second of said walls being provided with a plurality of coupling portions with the first wall comprising a first coupling portion disposed in the plane of the first wall and the second wall comprising a second coupling portion disposed in the plane of the second wall, said first coupling portion and second coupling portion directly cooperating with each other, wherein the first coupling portion comprises a slit extending through the first wall and the second coupling portion comprises a lip projecting from an edge of the second wall, the lip and the edge defining an aperture or slot having a width that is smaller than a thickness of the second wall, wherein the first wall comprises a recess contiguous to the slit for accommodation of at least a portion of the lip.

2. Coffin according to claim 1, wherein all of said walls comprise the same material.

3. Coffin according to claim 1, wherein the slit has a width corresponding with the thickness of the second wall.

4. Coffin according to claim 1, wherein the aperture or slot has a width that almost equals a thickness of the first wall at the location of the recess.

5. Coffin according to claim 1, wherein the bottom wall is the second wall and comprises said lip.

6. Coffin according to claim 5, wherein the lip also forms a handle.

7. Coffin according to claim 5, wherein one of the longitudinal walls is the first wall and wherein the bottom wall comprises a plurality of lips and each of the longitudinal walls is provided with a slit for each of the plurality of lips of the bottom wall.

8. Coffin according to claim 1, wherein one of the end walls is the first wall and one of the longitudinal walls is the second wall, and wherein each of the longitudinal walls comprises a plurality of lips at an end edge and each of the end walls comprises a plurality of slits for cooperation with the lips provided at the end edges of the longitudinal walls.

9. A coffin according to claim 8, wherein the plurality of lips at the end edges of the longitudinal walls have open ends that are upwardly oriented.

10. Coffin according to claim 1, wherein one of the longitudinal walls is the second wall and wherein each of the longitudinal walls has an upper edge comprising a plurality of lips and the upper wall is the first wall and comprises a plurality of slits cooperating therewith.

11. Coffin according to claim 1, wherein the walls are perfectly flat.

12. A coffin according to claim 1, wherein said at least first and second walls connect to each other by means of a snap connection defined by the first and second coupling portions.

13. Coffin according to claim 12, wherein the snap connection locks the first and second coupling portions.

14. A coffin according to claim 1, wherein the upper wall is disposable on both end walls.

15. A coffin according to claim 1, wherein said walls are adapted to be stacked onto each other in the shape of a package.

16. A coffin for a deceased, comprising a bottom wall, two longitudinal walls, two end walls and an upper wall, wherein the walls cooperate to define an interior for storing the deceased and are made of the same material, wherein at least a first and a second of the walls connect to each other by means of a snap connection, wherein the snap connection comprises a lip formed in one-piece with the first wall and which enters into a snap connection with a recess in the second wall, wherein the second wall is provided with a snap cam near the recess, wherein said recess in the second wall has a supporting plane for the lip and said recess is formed contiguous with a slit in the second wall, said slit comprising an elongated through hole for passing said lip, and said recess being located adjacent said elongated through hole.

17. A coffin according to claim 16, wherein the walls are free from portions protruding from main surfaces thereof.

18. Coffin according to claim 17, wherein said at least first and second walls enter into said snap connection by sliding.

19. A coffin according to claim 16, wherein the lip is resiliently deformable.

20. Coffin according to claim 19, wherein the lip can be resiliently bent aside with respect to a plane of the first wall.

21. Coffin according to claim 16, wherein the lip can spring back behind the snap cam in order to be locked.

22. Coffin according to claim 16, wherein said recess is located at a side of the second wall facing away from the first wall.

23. Coffin according to claim 16, wherein said walls are adapted to be stacked onto each other in the shape of a package.

* * * * *